252-146 AU 115 EX
5/19/87 OR 4,666,625

United States Patent [19]

Shaer et al.

[11] Patent Number: 4,666,625

[45] Date of Patent: May 19, 1987

[54] METHOD OF CLEANING CLOGGED DRAINS

[75] Inventors: Elias H. Shaer, Cincinnati, Ohio; Anthony R. Zembrodt, Covington, Ky.

[73] Assignee: The Drackett Company, Cincinnati, Ohio

[21] Appl. No.: 675,114

[22] Filed: Nov. 27, 1984

[51] Int. Cl.[4] ..... C11D 7/08; C11D 7/10; C23G 1/04

[52] U.S. Cl. ..... 252/146; 252/142; 134/22.11; 134/40; 134/41

[58] Field of Search ..... 252/142, 143, 147, 148, 252/146; 134/41; 210/723

[56] References Cited

U.S. PATENT DOCUMENTS

| | | | |
|---|---|---|---|
| 1,371,584 | 3/1921 | Urruty | 252/142 |
| 1,582,974 | 5/1926 | Garbarino | 252/142 |
| 1,837,118 | 12/1931 | Elder | 252/147 |
| 2,049,517 | 8/1936 | Saukaitis | 252/147 |
| 2,257,467 | 9/1941 | Jacobson | 252/145 |
| 2,497,057 | 2/1950 | Pape | 252/142 |
| 2,631,950 | 3/1953 | Rosenfeld et al. | 134/3 |
| 2,796,334 | 6/1957 | Robinson | 252/142 |
| 3,173,875 | 3/1965 | Wegst | 252/105 |
| 3,318,815 | 5/1967 | Remler et al. | 252/106 |
| 3,353,995 | 11/1967 | Teumac | 134/3 |
| 3,440,170 | 4/1969 | de Hek | 252/147 |
| 3,538,008 | 11/1970 | Ancel et al. | 252/146 |
| 3,740,331 | 6/1973 | Anderson et al. | 210/912 X |
| 3,791,977 | 2/1974 | Ancel | 252/156 |
| 3,925,229 | 12/1975 | Bolsing | 252/136 |
| 3,928,211 | 12/1975 | Browning et al. | 252/8.5 B |
| 4,014,804 | 3/1977 | Anderson | 252/85 |
| 4,096,871 | 6/1978 | Vlahakis | 134/40 |
| 4,220,550 | 9/1980 | Frenier et al. | 252/180 |
| 4,222,886 | 9/1980 | Connelly, Jr. | 252/149 |
| 4,244,833 | 1/1981 | Tomaszewski | 252/101 |
| 4,276,185 | 6/1981 | Martin | 252/87 |
| 4,289,639 | 9/1981 | Buske | 252/87 |
| 4,339,282 | 7/1982 | Lada et al. | 134/3 |
| 4,380,501 | 4/1983 | Wojtowicz et al. | 252/186.24 |
| 4,395,344 | 7/1983 | Maddox | 252/99 |

FOREIGN PATENT DOCUMENTS

| | | |
|---|---|---|
| 44008 | 4/1974 | Japan . |
| 50208 | 5/1978 | Japan . |
| 50207 | 5/1978 | Japan . |
| 233632 | 5/1925 | United Kingdom . |
| 791887 | 3/1958 | United Kingdom . |
| 795980 | 6/1958 | United Kingdom . |
| 1242221 | 8/1971 | United Kingdom . |

*Primary Examiner*—Prince E. Willis
*Attorney, Agent, or Firm*—Charles J. Zeller

[57] ABSTRACT

An acid cleaner composition to remove deposits capable of reacting with the acid and also forming thereby hydrogen sulfide, comprising from about 5 to 95% by weight of an acid having an ionization constant of at least about $1.75\times10^{-5}$, and an effective amount of a hydrogen sulfide scavenger agent providing a cation reactive with hydrogen sulfide to form a water-insoluble sulfide, whereby a substantial portion of the hydrogen sulfide is converted to said insoluble sulfide. The cations include $Cu^{+2}$, $Pb^{+2}$, $Cd^{+2}$, $Sb^{+3}$, and $Sn^{+4}$, while typical acids are sulfuric, sulfamic, and oxalic. Preferred ranges, for a drain cleaner composition, are from about 40 to about 95% acid by weight, and from 2 to about 10% scavenger agent by weight. The compositions may be in solid form, or as an aqueous solution, containing preferably from 2 to 80% water. Corrosion inhibitors and carbon dioxide generating agents may be included. In a particularly preferred embodiment, ammonium chloride may be incorporated in an amount of from 0.1 to 10% by weight.

13 Claims, No Drawings

METHOD OF CLEANING CLOGGED DRAINS

FIELD OF INVENTION

This invention relates to acid cleaners, i.e., cleaning compositions that contain acidic agents, in particular, strong acidic agents, as a principle active cleaning ingredient, and to a cleaning process that employs such compositions. The composition and method are concerned with general metal cleaning, but have particular application in drain cleaning for the removal of drain clogs.

BACKGROUND OF INVENTION

Acids, particularly strong acids, have the ability to degrade a wide variety of substances normally found in drains. They hydrolyze proteins and celluloses and convert insoluble salts to soluble salts. They react with carbonates to liberate carbon dioxide, thereby producing turbulence, and they generate a fair amount of heat upon dilution with water. These are very desirable properties for drain cleaners. Similarly, acids are suitable for cleaning sulfide scales from metal surfaces, for example, from the interior of pipes in refinery installations. However, one of the major problems associated with the use of acid cleaner compositions, particularly as drain and pipe cleaners, is possible hydrogen sulfide liberation.

It has now been found that cations of the copper subgroup of the cation group 2 and some cations of the arsenic subgroup of the cation group 2 serve as scavengers for hydrogen sulfide ($H_2S$) when contained in acid cleaner compositions. When incorporated in acid cleaner compositions, the presence of these scavengers reduces the amount of hydrogen sulfide gas that is generated during the cleaning operation.

U.S. Pat. No. 4,220,550 to Frenier et al describes an aqueous acid composition for removing metal-sulfide scales from metal surfaces. The patentees also suggest the use of an aldehyde to prevent the evolution of $H_2S$. The use of the cations employed in this invention is not shown in Frenier et al. Moreover, the mechanism of $H_2S$ scavenging that operates in the present invention obviously is far different from that in the case of Frenier et al as will be clear from the following disclosure.

U.S. Pat. No. 4,289,639 to Buske discloses an invention similar to that shown by Frenier et al. In Buske, glyoxylic acid is used to prevent the generation of hydrogen sulfide gas. In Martin, U.S. Pat. No. 4,276,185, chelating agents such as nitrilotriacetic acid, ethylenediaminetetraacetic acid and citric acid are used to protect against hydrogen sulfide evolution, the compositions in Martin having a pH between 8 to 10. The comments made above with regard to Frenier et al are also applicable to the Buske and Martin patents.

SUMMARY OF THE INVENTION

It is an object of the present invention to provide an acid cleaner to remove deposits capable of reacting with the acid and also forming thereby hydrogen sulfide.

It is a primary object of the invention to provide an acid cleaner containing an effective amount of a hydrogen sulfide scavenger agent to react with the hydrogen sulfide formed in view of the acid attack on the deposit, to form a water insoluble sulfide.

It is a further object to provide an acid cleaner composition containing an acid and an effective amount of a hydrogen sulfide scavenger agent providing a cation reactive with the hydrogen sulfide, whereby at least a substantial portion of the hydrogen sulfide is rendered innocuous.

Another object is to provide an acid drain cleaner composition and a method of cleaning drains.

Yet a another object of the present invention is to provide an acid cleaner composition providing protection to metal pipes.

These and other objects and advantages of the present invention will be more fully disclosed in the followng section Detailed Description of Invention, a summary of which follows.

The acid cleaner composition of the present invention concerns the removal with an acid of deposits capable of reacting with the acid and also forming thereby hydrogen sulfide. In particular the composition has utility as a drain cleaner, the clogs present in drains often containing such hydrogen sulfide forming deposits.

The acid cleaner composition comprises from about 5 to about 95% of an acid having an ionization constant of at least $1.75\times10^{-5}$, and an effective amount of a hydrogen sulfide scavenger agent providing a cation reactive with hydrogen sulfide to form a water-insoluble sulfide, whereby a substantial portion of the hydrogen sulfide is converted to said insoluble sulfide.

Typical acids that may be included are sulfamic, sulfuric, succinic, oxalic and the like. The cations are those of the copper subgroup and certain cations of the arsenic subgroup. These include $Cu^{+2}$, $Pb^{+2}$, $Cd^{+2}$, $Sb^{+3}$, $Sn^{+4}$ and the like. The salts of these cations include those of sulfates, chlorides, carbonates, phosphates, acetates, and the like. Preferably, the acid is from 10 to 90% by weight, while the scavenger agent is 1 to 10% by weight. The composition may be in particulate solid or aqueous form, the water, if present, being preferably from about 10 to 80% by weight. The composition may further contain an agent to increase solubility of the scavenger salt in the composition, for example, ammonium chloride in an amount of from 0.1 to 10% by weight. Ammonium chloride has also been found to reduce chemical attack by the acid on certain metals. In addition, a carbon dioxide generating agent and a corrosion inhibitor may optionally be incorporated.

The composition is used by contacting it with the deposit to be removed from the surface to be cleaned. In the case of a drain cleaner composition, the composition is poured into the clogged drain, followed, preferably, by a water flush, especially in the case of a solid composition.

DETAILED DESCRIPTION OF INVENTION

As indicated above, the class of hydrogen sulfide scavengers made use of herein, are all the cations of the copper subgroup (cation group 2) and some of the cations in the arsenic subgroup. These include $Cu^{+2}$, $Pb^{+2}$, $Hg^{+2}$, $Bi^{+3}$, $Cd^{+2}$, $As^{+5}$, $Sb^{+3}$ and $Sn^{+4}$. They function by precipitating the metal sulfide in acid media. The following reaction is illustrative of the mechanism:

$$Cu^{+2}+H_2S\rightarrow CuS\downarrow+2H^+$$

The cations that serve as $H_2S$ scavengers in the present invention are usually employed in the acid cleaner composition in the form of a salt that is significantly soluble in the acid. This solubility need only be sufficient to dissolve enough of the cation to function effectively to reduce the evolution of $H_2S$ in the cleaning operation to an acceptable level. The salts of the appropriate cations that can serve this purpose include, for example, the sulfates, chlorides, acetates, bromides, chromates, carbonates, borates, phosphates, manganates, and the like. By way of example, the following may be mentioned: copper sulfate, copper chloride, lead acetate, bismuth triacetate, copper bromide, cadmium chloride, bismuth carbonate, tin acetate, antimony sulfate, and copper hydroxide.

The concentration of the scavenger salt in the present cleaner compositions may vary depending upon the end use that is contemplated. Generally, an effective amount will be in the range of from about 0.5% to about 25% by weight based on the total weight of the composition. The scavenger salt is typically present in the range of from about 2% to about 20% by weight based on the total weight of the composition, the preferred range being from about 2% to about 10% on the same weight basis. In preparing the composition, the solubility of the scavenger salt should be considered in the acid solution. Thus, particularly at high acid concentrations, certain of the scavenger salts may present solubility difficulties requiring selection of another, more soluble salt.

In preparing the compositions of this invention, any of a variety of acidic agents having an ionization constant of at least about $1.75\times10^{-5}$ may be employed as the active cleaning agent. As used herein, the term acidic agent is employed to designate the conventional acids having the general formula HA wherein A is an anion and H is hydrogen as well as other materials that act as acids in solution, for example sodium bisulfate. A number of acidic agents are known in the prior art which will perform the necessary cleaning function. By way of example, mention may be made of the following: sulfuric acid, phosphoric acid, citric acid, sulfonic acid, sodium bisulfate, oxalic acid, succinic acid, sulfamic acid, acetic acid, chromic acid, hydrochloric acid, hydrazine monosulfuric acid, and the like.

The quantity of acid used in this invention is also variable depending on the use of results desired. In most cases, the acidic agent will constitute between about 5% to about 95% by weight of the composition with the preferred range being from about 10% to about 90% on the same weight basis. In cases where the invention is to be used in a metal cleaning composition the acid concentration ranges preferably from 5 to 65% by weight. When used as drain cleaner, it is more useful to have higher concentrations ranging from 40 to 95% by weight.

In some applications of the present invention, it may be useful to have a corrosion inhibitor contained in the composition. Several agents of this kind known in the prior art can be used for the present purposes. These include such agents as sodium and potassium salts of silicates, polyphosphates, chromates, dichromate, phosphonates, and sarcosinates. Other corrosion inhibitors include aminomethylene phosphonate and hydroxyethylidene-1,1-diphosphonate. When it is employed, the corrosion inhibitor will generally comprise from about 0.1% to about 10% by weight, preferably from about 1% to about 5% by weight based on the total weight of the composition.

It has also been found that it is advantageous to incorporate a quantity of ammonium chloride in the compositions of this invention. In some cases, it increases the solubility of the $H_2S$ scavenger in the acidic composition. For example, it has been found that ammonium chloride increases the solubility of copper sulfate in sulfuric acid solution so that larger quantities of copper sulfate ($CuSO_4$) can be incorporated in the acid cleaner when desirable. Also, unexpectedly, ammonium chloride, in combination with copper sulfate ($CuSO_4$) act jointly to protect galvanized iron, cast iron, brass and copper against corrosion by acids. In this case, therefore, it can also function as a corrosion inhibitor. When ammonium chloride is employed, it will generally be used at a level in the range of from about 0.1% to about 10% by weight based on the total weight of the composition. The preferred range for this material is from about 0.5% to about 5% on the same weight basis.

To improve the elegance of the products of this invention, the usual ingredients that will affect this purpose can be employed. These will include such items as perfumes, dyes, etc.

The composition of the present invention may take the form of a solid or a liquid. In the former case, the balance of the composition will be made up by a solid vehicle. Examples of such vehicles are sodium and potassium carbonates, chlorides, borax, and the like. The carbonates also serve to generate carbon dioxide for turbulence during use, especially in a drain cleaner composition. The preferred form of the present products are as liquids. In this case, the balance of the composition will be a liquid vehicle and especially, water.

Clay material from 26 clogged drains (15 clogged bathroom drains and 11 clogged kitchen drains) was collected and mixed together. Two grams of the mixed clog material additionally containing 0.06 g. ferric sulfide was then reacted with 25 ml. of the several acid cleaner compositions identified in Table A in a 150 ml. beaker for 30 minutes. The percent reduction in hydrogen sulfide released in the presence of compositions containing a scavenger as compared to scavenger free acid cleaner compositions is reported in Table A.

TABLE A

| | Percent Reduction in $H_2S$ Liberated | | | | | |
|---|---|---|---|---|---|---|
| | ACID | | | | | |
| Scavenger | 10% $H_2SO_4$ | 50% $H_2SO_4$ | Liquid Fire* | 50% $H_3PO_4$ | 50% Citric | 15% Sulfamic |
| None | 0 | 0 | 0 | 0 | 0 | 0 |
| 5% $CuSO_4$ | — | 81 | 89 | 98 | 98 | 98 |
| 2% Lead Acetate | 30 | — | — | — | — | — |

*Liquid Fire is a commercial drain cleaner based on concentrated $H_2SO_4$

The ability of the $H_2S$ scavengers of this invention to prevent the liberation of $H_2S$ gas was determined as follows. During the reaction, a piece of filter paper with three drops of lead acetate was placed on the mouth of the reaction beaker. The amount of $H_2S$ liberated was estimated by the degree of darkness produced on the lead acetate filter. The semiquantitative values shown in Table A were obtained by measuring the reflectance (L value) for the darkened lead acetate filters with a color difference meter (CDM). The L value for the darkest filter papers was arbitrarily set equal to zero percent reduction and L value for a clean unused filter was set equal to 100% reduction. The values in Table A were estimated using the equation:

$$\% \ H_2S \text{ reduction} = \frac{L_s - L_o}{L_c - L_o} \times 100$$

where $L_s$ is the L value for the sample, $L_o$ is the L value in the absence of scavengers, and $L_c$ is the L value for clean filter paper. The estimated percent reduction appears to be very consistent with the visual observations. The percent weight loss was determined by the usual gravimetric method.

Simultaneous with the determination of $H_2S$ reduction, the percent clog reacted with the compositions of Table A was determined. The results are shown in Table B.

TABLE B

| | Percent Weight Loss After 30 Min. at Room Temperature | | | | | |
|---|---|---|---|---|---|---|
| | ACID | | | | | |
| Scavenger | 10% $H_2SO_4$ | 50% $H_2SO_4$ | Liquid Fire | 50% $H_3PO_4$ | 50% Citric | 15% Sulfamic |
| None | 15.7% | 37.8% | 52.5% | 34.5% | 8.9% | 12.9% |
| 2% Lead Acetate | 14.2 | — | — | — | — | — |
| 5% $CuSO_4$ | — | 32.0 | 42.0 | 27.0 | 9.4 | 10.1 |

The first row shows the percent weight loss with the various acids in the absence of scavengers. The following rows show the effect of scavengers on the weight loss. It is noted that in most cases the scavenger reduces the amount of weight loss. This is probably due to the conversion of soluble metal salts to insoluble metal oxides or due to the precipitation of an insoluble sulfide, e.g., where copper sulfate or lead acetate is used as the scavenger. In real applications, these variations in weight loss are not expected to be serious negatives because the resulting insolubles will most likely be in a fine dispersed state and will be removed by the force of water currents.

In summary, the generalized formula acid cleaners embodied in this invention is given in Table I below, as well as the preferred range of concentrations for the various ingredients for metal cleaning and for drain cleaning. Specific examples of drain cleaner compositions according to the percent invention are recited in Table II.

TABLE I

| Ingredient | Range of Interest Wt. % | Preferred Range Wt. % Metal Cleaning | Preferred Range Wt. % Drain Cleaning |
|---|---|---|---|
| Acid | 5-95 | 5-65 | 40-95 |
| $H_2S$ Scavenger | Effective Amount (e.g. 0.5-25%) | 2-10 | 2-10 |
| Corrosion Inhibitor | 0.1-10 | 0.5-5 | 0.5-5 |
| Water, Solid Vehicles, Perfume, Dye | Q.S. | Q.S. | Q.S. |
| | 100.00% | 100.00% | 100.00% |

Corrosion inhibitors and other additives are optional.

TABLE II

| | EXAMPLES Wt. % | | | | | | | | | |
|---|---|---|---|---|---|---|---|---|---|---|
| Ingredients | 1 | 2 | 3 | 4 | 5 | 6 | 7 | 8 | 9 | 10 |
| Examples of Suitable Acids: | | | | | | | | | | |
| Sulfuric | 90 | | | | | | | | 20 | |
| Citric | | 50 | 90 | 50 | | | | 25 | | |
| Phosphoric | | | | | | | | | | 50 |
| Sulfamic | | | | | 80 | | | | | |
| Sodium Bisulfate | | | | | | 85 | 60 | | | |

TABLE II-continued

| | EXAMPLES Wt. % | | | | | | | | | |
|---|---|---|---|---|---|---|---|---|---|---|
| Ingredients | 1 | 2 | 3 | 4 | 5 | 6 | 7 | 8 | 9 | 10 |
| Examples of Suitable Scavengers: | | | | | | | | | | |
| Copper Sulfate | 5 | 5 | 10 | | 5 | 10 | 20 | 15 | 5 | 5 |
| Lead Acetate | | | | 25 | | | | | | |
| Examples of Suitable Corrosion Inhibitors: | | | | | | | | | | |
| Sodium Silicate | | 1 | | | | | | | | 1 |
| Sodium Polyphosphate | | | | 1 | 5 | | 1 | | | |
| Sodium Chromate | | | | | | | | | 5 | |
| Sodium Dichromate | 5 | | | | 5 | 5 | | | | |
| Sodium Chloride | | | | | | | 19 | 60 | | |
| Water, Perfume, Dye | 0 | 44 | 0 | 24 | 0 | 0 | 0 | 70 | 44 | |

Other ingredients may be included as needed. For example, solid formulae such as 3, 5, 6, 7 and 8 may contain sodium carbonates to generate carbon dioxide gas for turbulence.

As indicated above, several advantages are obtained when an ammonium chloride is added to the combination acid/$H_2S$ scavenger compositions of this invention and particularly to the $CuSO_4$—$H_2SO_4$ solution system. The generalized formulas of this type are given in Table III below

TABLE III

| Ingredient | Range in Wt. % | Preferred Range Wt. % Drain Cleaning |
|---|---|---|
| Acid | 5-95 | 40-95 |
| Copper Sulfate | 0.5-25 | 2-10 |
| Ammonium Chloride | 0.1-10 | 0.5-5 |
| Water, Solid Vehicles, Perfume, Dye | Q.S. | Q.S. |
| | 100% | 100% |

The effect of $NH_4Cl$ on the solubility of real clog material has been studied under acidic, neutral, and basic conditions. It was found that $NH_4Cl$ has a synergistic effect under acidic conditions, little effect under neutral conditions, and an antagonistic effect under basic conditions.

TABLE IV

| | The Effect of $NH_4Cl$ on the Solubility of Real Clog Material | |
|---|---|---|
| Reagent | Wt. % Loss | |
| D.I. Water | 3.1 | Neutral |
| 5% $NH_4Cl$ | 3.6 | |
| 10% $H_2SO_4$ | 22.8 | Acidic |
| 10% $H_2SO_4$ + 5% $NH_4Cl$ | 25.1 | |
| 10% $H_2SO_4$ + 5% $CuSO_4$ | 20.7 | |
| 10% $H_2SO_4$ + 5% $CuSO_4$ + 2.5% $NH_4Cl$ | 23.1 | |
| 50% $H_2SO_4$ + 5% $CuSO_4$ | 31.7 | |
| 50% $H_2SO_4$ + 5% $CuSO_4$ + 2.5% $NH_4Cl$ | 34.8 | |
| Average effect of $NH_4Cl$ under acid conditions | +2.6% | |
| 10% EDTA + 1% NaOH | 11.4 | Basic |
| 10% EDTA + NaOH + 2.5% $NH_4Cl$ | 8.8 | |
| 20% Monoisopropylamine (MIPA) | 10.1 | |
| 20% MIPA + 5% $NH_4Cl$ | 7.5 | |

Note that the effect of $NH_4Cl$ in acidic media persists in the presence and absence of $CuSO_4$.

The ability of $NH_4Cl$ to increase the solubility of $CuSO_4$ in $H_2SO_4$ was demonstrated by comparing the solubility of $CuSO_4$ in aqueous sulfuric acid with the same aqueous sulfuric acid containing $NH_4Cl$. The formula was compared and the results are given in Table V below.

TABLE V

| Formula | Solubility of $CuSO_4$ |
|---|---|
| 5 g $CuSO_4$ + 95 g of 50% $H_2SO_4$ | Slightly soluble |
| 5 g $CuSO_4$ + 92.5 g of 50% $H_2SO_4$ + 2.5 g $NH_4Cl$ | Completely soluble |

The ability of the ammonium chloride ($NH_4Cl$) and copper sulfate ($CuSO_4$) to protect brass, copper, galvanized iron, and cast iron is illustrated by the results shown in the following Table VI:

TABLE VI

Weight Change of Certain Metals After Fifty 10-minute Immersions in the Specified Solutions

| | Weight Change in g/sq. in. | | | | |
|---|---|---|---|---|---|
| Solution | Galv. Iron | Aluminum | Brass | Copper | Cast Iron |
| 1. 50% $H_2SO_4$ | −0.648 | −0.033 | −0.00053 | −0.00057 | −0.327 |
| 2. 50% $H_2SO_4$ + 5% $CuSO_4$ | −0.785 | +0.048* | −0.0021 | −0.0014 | −0.058 |
| 3. 50% $H_2SO_4$ + 2% $Na_2Cr_2O_7$ | −1.487 | −0.021 | −0.347 | −0.562 | −0.310 |
| 4. 50% $H_2SO_4$ + 5% $CuSO_4$ + 2% $Na_2Cr_2O_7$ | −1.483 | −0.011 | −0.267 | −0.379 | −0.322 |
| 5. 50% $H_2SO_4$ + 5% $CuSO_4$ + 2.5% $NH_4Cl$ | +0.035* | Strong Reaction | +0.019* | +0.044* | +0.147* |

*Signifies protection. In case of aluminum, brass, and copper, the protection seems to be caused by the plating of a continouos copper film on the surface of the metal under study. In the cases of the galvanized and cast iron, the protection is in the form of depositied scales.

These results were obtained by monitoring the decrease or increase in the weights of metal chips after fifty immersions in the specified solutions. Each immersion lasted for a period of 10 minutes. After each immersion, the metal chips were washed, dried, and weighed. The difference between the initial weight and the final weight (after fifty immersions) was divided by the surface area of that chip to obtain the results shown in the above Table VI. Tests were conducted in triplicate, and the metal chips were tested in separate beakers to prevent cross contamination.

Solution #1 (50% $H_2SO_4$) was found very corrosive to galvanized iron and cast iron, the two metals most often used in drain pipes. The same solution is seen to be corrosive to aluminum and very slightly corrosive to brass and copper.

Solution #2 (50% $H_2SO_4$+5% $CuSO_4$) was found to protect aluminum against acid attack and to decrease the rate of corrosion of cast iron, but the same solution seems to be more corrosive to brass, copper, and possibly galvanized iron. The merit of this solution is that it is protective of aluminum and mild on cast iron.

Contrary to expectation, sodium dichromate ($Na_2Cr_2O_7$), which is a known corrosion inhibitor, was found to accelerate the corrosion of galvanized iron, brass and copper. Its effect on aluminum and cast iron seems to be negligible. Based upon the literature, $Na_4Cr_2O_7$ might offer protection at lower concentrations.

Solution #5 (50% $H_2SO_4$, 5% $CuSO_4$ and 2.5% $NH_4Cl$) was found to protect brass and copper by plating a continuous copper film on the surface of these metals. It was also found to protect galvanized and cast iron by the deposition of scales on these two metals.

The uniqueness of the $CuSO_4$-$NH_4Cl$ system is that it eliminates two major disadvantages associated with the use of acids as drain cleaners. Since most drain pipes are constructed of galvanized iron, cast iron, brass and/or copper, this system allows the use of acid as drain cleaners with minimum risk of hydrogen sulfide generation and/or metal corrosion.

I claim:

1. A method of cleaning clogged drains clogged with deposits capable of reacting with an acid to form hydrogen sulfide as a reaction product, the method comprising the steps of (1) contacting the clog deposit accumulated within the drain with a composition consisting essentially of (a) from about 40 to 95% by weight of an acid selected from the group consisting of sulfuric, sulfamic, oxalic, hydrochloric, and phosphoric acids and sodium bisulfate, and (b) a hydrogen sulfide scavenger agent providing a cation from the group consisting of $Cu^{+2}$, $Pb^{+2}$, $Hg^{+2}$, $Bi^{+3}$, $Cd^{+2}$, $As^{+5}$, $Sb^{+3}$, and $Sn^{+4}$, said scavenger agent being in an amount effective to convert substantially all of the hydrogen sulfide formed as said reaction product of said acid and said clog to a water-insoluble sulfide, whereby a substantial portion of the hydrogen sulfide is converted to said insoluble sulfide, and (2) thereafter flushing the drain with water.

2. The method of claim 1 wherein the hydrogen sulfide scavenger agent is present in an amount of from about 0.5 to 20% by weight of the composition.

3. The method of claim 2 wherein the hydrogen sulfide scavenger agent is selected from the group consisting of the sulfate, chloride, carbonate, phosphate, acetate, and borate salts of the cations of claim 1.

4. The method of claim 2 wherein the hydrogen sulfide scavenger agent is selected from the group consisting of copper sulfate, copper chloride, lead acetate, antimony sulfate, and tin acetate.

5. The method of claim 2 wherein the composition contains from about 25 to 50% water.

6. The method of claim 5 wherein the hydrogen sulfide scavenger agent is a salt of a cupric cation, and wherein the composition contains from about 0.1 to less than 10% ammonium chloride.

7. The method of claim 6 wherein the hydrogen sulfide scavenger is present in an amount of from about 2 to 10% by weight of the composition.

8. The method of claim 6 wherein the hydrogen sulfide scavenger is copper sulfate.

9. The method of claim 5 wherein the composition also includes a corrosion inhibitor in an amount of from about 0.1 to about 10% by weight.

10. The method of claim 9 wherein the corrosion inhibitor is selected from the group consisting of sodium and potassium phosphate, polyphosphate, phosphonate, chromate, dichromate, and silicate, aminomethylenephosphonate and hydroxyethylidene-1,1-diphosphonate.

11. The method of claim 2 wherein the composition is nonaqueous and also includes a carbon dioxide gas generating agent.

12. The method of claim 11 wherein the carbon dioxide generating agent is sodium carbonate.

13. The method of claim 7 wherein ammonium chloride is present in an amount of from about 0.5 to 5% by weight of the composition.

* * * * *